US011287211B2

(12) United States Patent
Seekins

(10) Patent No.: US 11,287,211 B2
(45) Date of Patent: Mar. 29, 2022

(54) OPEN-BREACH FIREARM ACTION WITH METALLIC INSERT

(71) Applicant: Glen Dale Seekins, Lewiston, ID (US)

(72) Inventor: Glen Dale Seekins, Lewiston, ID (US)

( * ) Notice: Subject to any disclaimer, the term of this patent is extended or adjusted under 35 U.S.C. 154(b) by 0 days.

(21) Appl. No.: 17/232,025

(22) Filed: Apr. 15, 2021

(65) Prior Publication Data

US 2021/0325142 A1 Oct. 21, 2021

Related U.S. Application Data

(60) Provisional application No. 63/010,474, filed on Apr. 15, 2020.

(51) Int. Cl.

| | |
|---|---|
| ***F41C 9/08*** | (2006.01) |
| ***F41A 3/18*** | (2006.01) |
| ***F41A 5/26*** | (2006.01) |
| ***F41A 3/66*** | (2006.01) |

(52) U.S. Cl.

CPC ..... *F41C 9/08* (2013.01); *F41A 3/18* (2013.01); *F41A 3/66* (2013.01); *F41A 5/26* (2013.01)

(58) Field of Classification Search

CPC ..... F41C 9/08

See application file for complete search history.

(56) References Cited

U.S. PATENT DOCUMENTS

| | | | | |
|---|---|---|---|---|
| 6,516,549 | B1 * | 2/2003 | Hildebrandt | F41C 9/08 42/51 |
| 6,647,653 | B1 * | 11/2003 | Hengstenberg | F41C 9/08 42/51 |
| 2019/0003801 | A1 * | 1/2019 | Ibarguren | F41C 9/08 |

FOREIGN PATENT DOCUMENTS

| | | | | |
|---|---|---|---|---|
| WO | WO-9923442 | A1 * | 5/1999 | F41C 9/08 |

* cited by examiner

*Primary Examiner* — Reginald S Tillman, Jr.

(74) *Attorney, Agent, or Firm* — Hogaboam Law Offices, PLLC; Romney J. Hogaboam

(57) ABSTRACT

A multi-piece action for a single-shot firearm. The action comprises an action body, an action liner, and a breech plug. The action body is configured to accept a firearm bolt. The action body is further configured to accept an action liner and hold that action liner in place. The action liner is configured to accept a barrel, preferably through a series of threads. The action liner is open at both ends and is configured to accept a breech plug.

16 Claims, 4 Drawing Sheets

OPEN-BREACH FIREARM ACTION WITH METALLIC INSERT

CROSS-REFERENCE TO RELATED APPLICATIONS

This application claims priority to provisional application 63/010,474 filed on Apr. 15, 2020.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not Applicable

STATEMENT REGARDING PRIOR DISCLOSURES BY AN INVENTOR OR JOINT INVENTOR

Not Applicable

BACKGROUND OF THE INVENTION

This invention relates to firearm receivers. A firearm receiver is the part of a firearm which provides a housing for the hammer, bolt or breechblock, and firing mechanism, and which is usually threaded at its forward portion to receive a barrel. Because a firearm receiver is often the item to which other components are attached, tight tolerances and consistency are desirable features. The receiver of a firearm is also often one of the heaviest components of a firearm, following the barrel and optic.

In the case of a bolt-action rifle, an action is generally a tube, open at both ends, with at least an opening in one side for a cartridge to be inserted and/or removed. A bolt-action rifle often also has an opening in bottom to allow cartridges to enter the action from a magazine. The bottom of an action for a bolt-action rifle is often configured with a mechanism, such as a hangar, by which a trigger may be attached. The top of an action for a bolt-action rifle is often configured with a mechanism, such as rails or threaded holes, by which an optic or other accessories may be attached.

Conventional bolt-action rifle actions are often manufactured from steel. Processes for manufacturing items from steel, such as through milling or turning on a lathe, are well developed and allow items of high-quality to be produced. Steel also has good strength characteristics for firearm actions. However, the weight of an action manufactured from steel can be significant and undesirable. In a lightweight rifle weighing 6-7 pounds, the action often accounts for at least 24 ounces of that weight.

DESCRIPTION OF RELATED ART INCLUDING INFORMATION DISCLOSED UNDER 37 CFR 1.97 AND 37 CFR 1.98

Not Applicable

BRIEF SUMMARY OF THE INVENTION

A multi-piece action for a single-shot firearm. The action comprises an action body, an action liner, and a breech plug. The action body is configured to accept a firearm bolt. The action body is further configured to accept an action liner and hold that action liner in place. The action liner is configured to accept a barrel, preferably through a series of threads. The action liner is configured to accept a breech plug open at both ends.

DETAILED DESCRIPTION OF THE INVENTION

Figure 1:
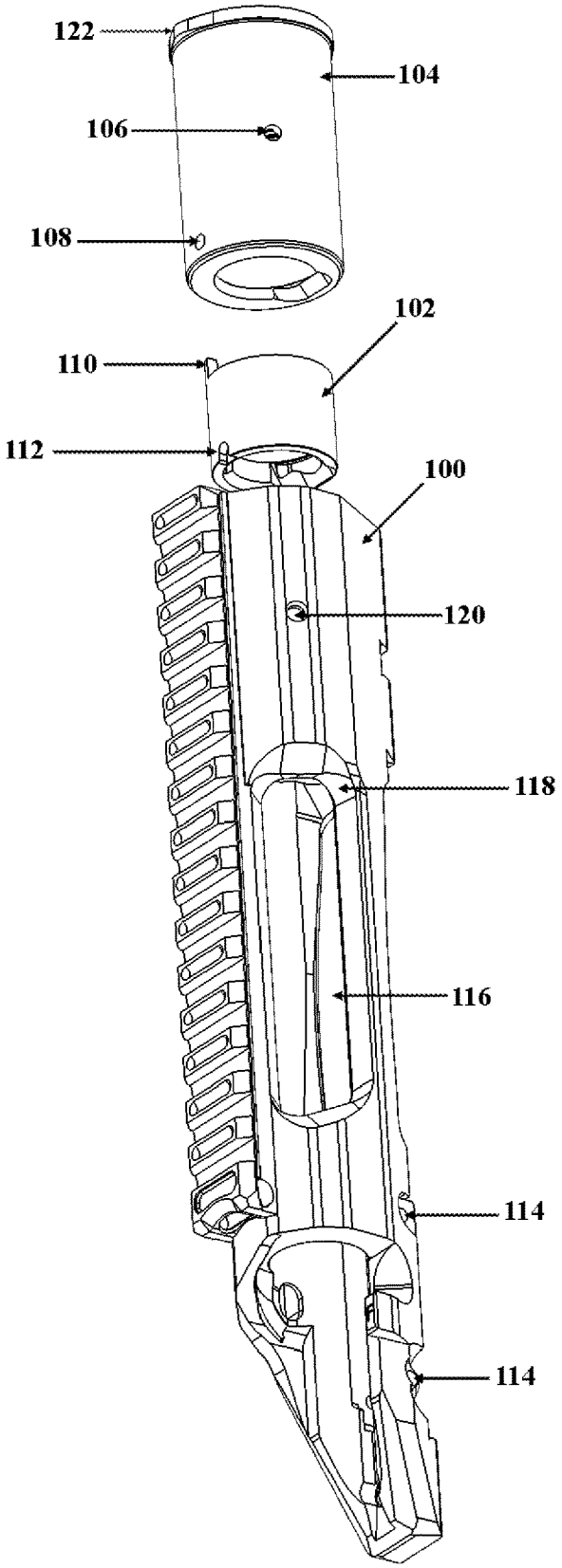
FIG. 1 shows an exploded view of an action of the present invention.
Figure 2:
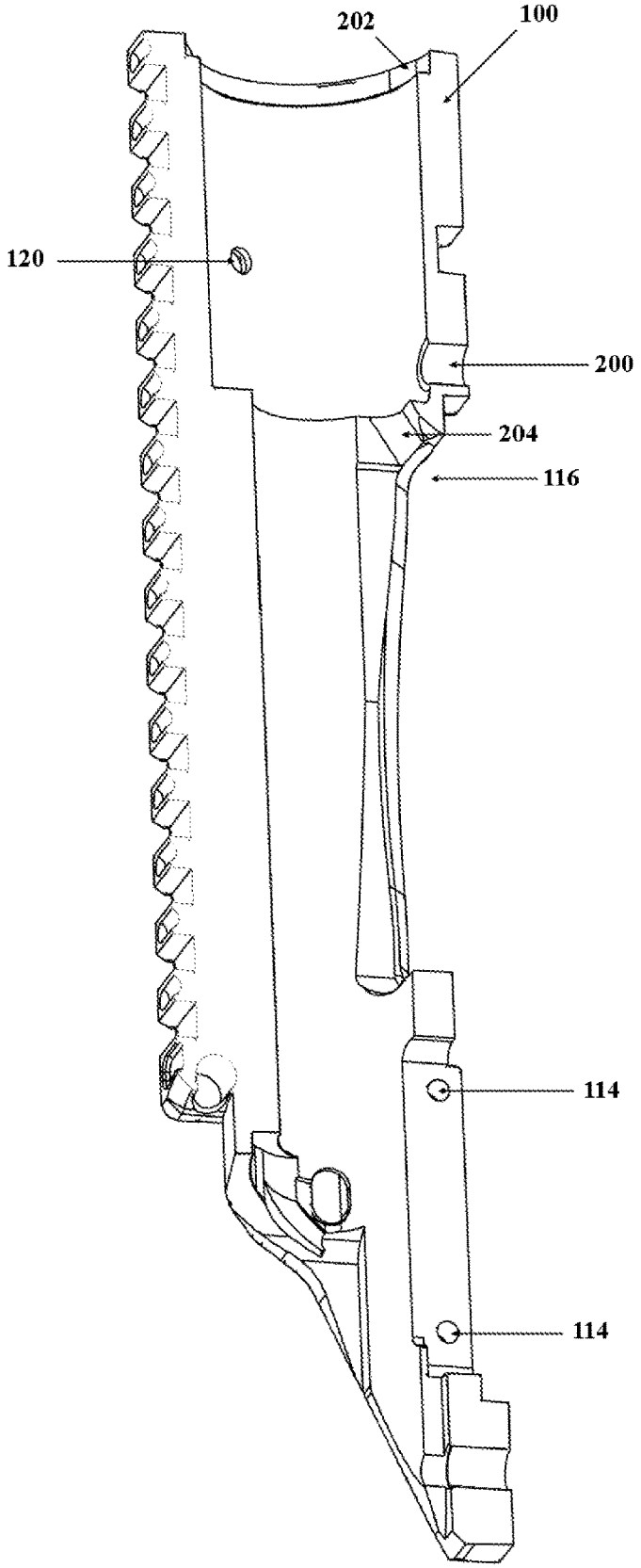
FIG. 2 shows a center vertical length-wise section view of an action body of the present invention.
Figure 3:
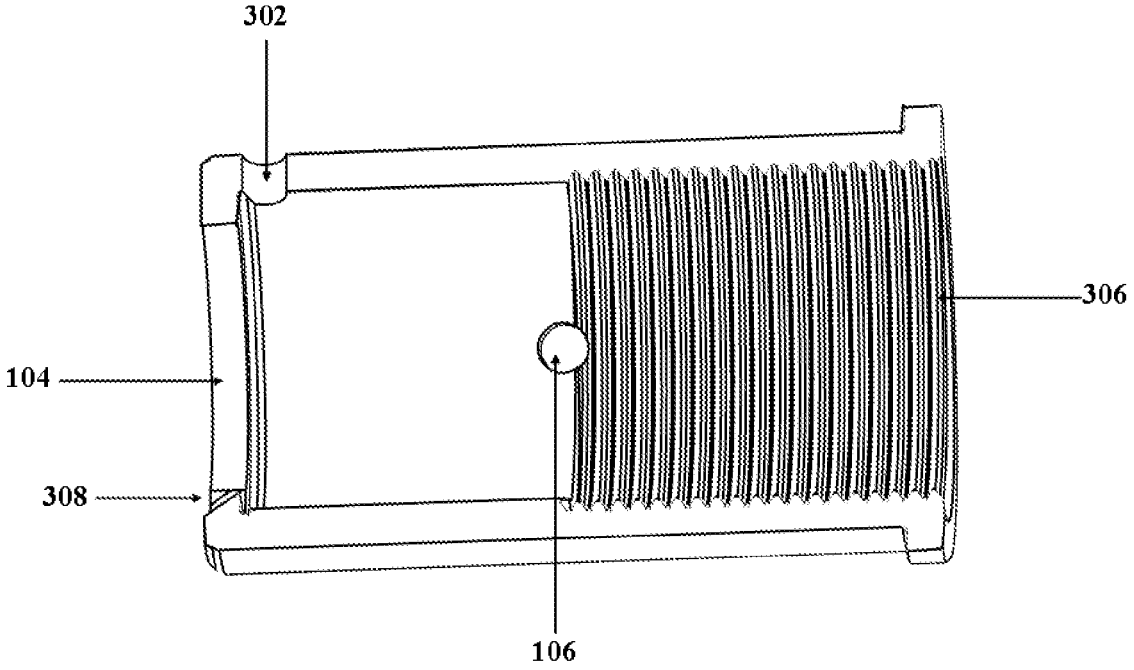
FIG. 3 shows a center vertical length-wise section view of an action liner of the present invention.
Figure 4:
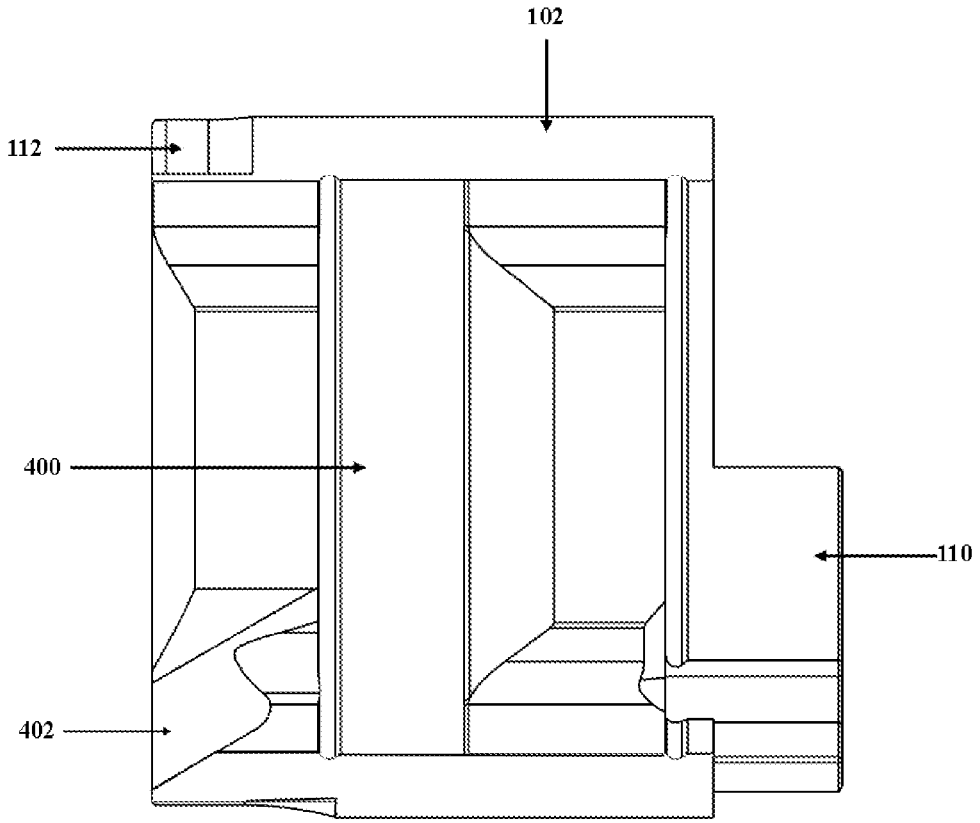
FIG. 4 shows a center vertical length-wise section view of a breech plug of the present invention.
Figure 5:
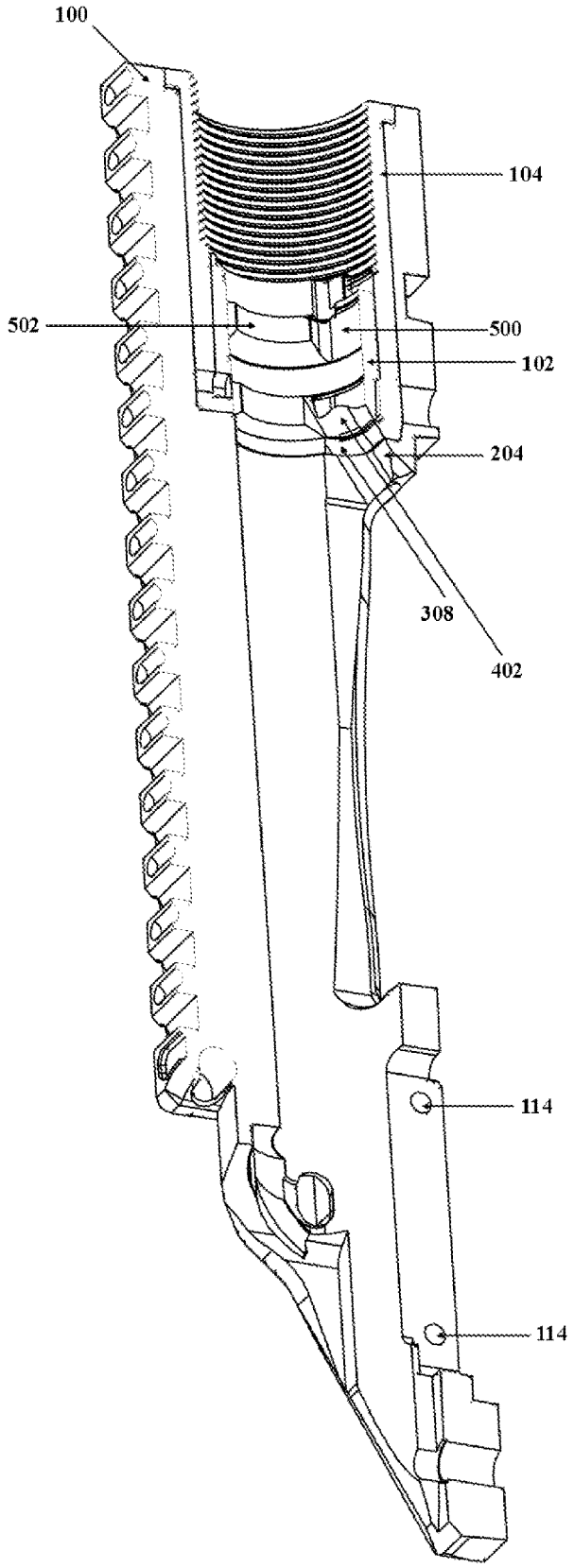
FIG. 5 shows a center vertical length-wise section view of an assembled action of the present invention.

The present invention is a multi-piece action for a single-shot firearm. The action comprises an action body 100. The action body 100 is preferably manufactured from metal. The action body 100 preferably has a hollow center running the length, front (muzzle) to back (breech), of the action body 100. The opening in the back of the action body 100 is configured to accept a firearm bolt. The opening in the front of the action body 100 is configured to accept a barrel. The action body 100 is preferably further configured with at least one opening 118 in a side by which a cartridge may be inserted and the case of a spent cartridge may be removed. In certain embodiments, the action body 100 is preferably further configured with an opening 116 configured to accept cartridges passing from a magazine into the action body 100 and the passage of cartridges from the action body 100 into the magazine when loading the magazine through the action.

The action body 100 is further configured to accept an action liner 104. In a preferred embodiment, outside of the action liner 104 is preferably generally cylindrical. In a preferred embodiment, the action body 100 opening in the front (muzzle) end is cylindrical and slightly larger in diameter than the exterior of the action liner 104 such that the action liner 104 can be inserted into the action body 100 from the front (muzzle) end. The action body 100 is further preferably configured with action liner alignment features 202. In a preferred embodiment, the action liner alignment features 202 comprise a slot in the wall action body 100 configured to accept a protrusion of the action liner thereby preventing rotation of the action liner relative to the action body.

In a preferred embodiment, the action body 100 further comprises feed ramp features 204. Feed ramp features 204 are features configured to direct a cartridge passing into the chamber of the firearm.

In a preferred embodiment, the action body 100 comprises a plurality of pressure relief features 120. In a preferred embodiment, the plurality of pressure relief features 120 comprise a plurality of holes passing radially through the action body 100 configured to align with a plurality of holes 106 in the action liner 104. In certain embodiments, the action body 100 further comprises features by which a trigger 114, optics, and/or a stock 200 may be attached to the action body 200.

In a preferred embodiment, the action body 100 further comprises action liner retention features 120. In a preferred embodiment, the action liner retention features 120 comprise a hole through which a blocking member may pass through the action body 100 into the action liner 104. In certain embodiments, action liner retention features may also function as pressure relief features.

The present invention further comprises an action liner 104. In a preferred embodiment, the action liner 104 is generally defined by cylindrical walls and is open at both front (muzzle) and back (breech) ends. In a preferred embodiment, thickness of the action liner 104 is greater at the front (muzzle) end creating a lip on the outside of the action liner 104. This muzzle lip preferably rests on the front (muzzle) of the action body 100 when the action liner 104 is inserted into the action body 100 to the desired depth. In a preferred embodiment, the action liner 104 is at least partially threaded 306 at the muzzle end to accept a threaded barrel.

In a preferred embodiment, the action liner 104 further comprises action body 100 alignment features 122. In a preferred embodiment, the action body alignment features 122 comprise a plurality of protrusions configured to fit in a plurality of slots 202 in the action body 100 thereby preventing rotation of the action liner 104 relative to the action body 100.

In a preferred embodiment, the action liner 104 further comprises breech plug alignment features 108. In a preferred embodiment, the breech plug alignment features 108 comprise a plurality of projections 108 from the action liner 104 toward the center of the action liner.

In a preferred embodiment, the action liner 104 further comprises action body retention features 106. In a preferred embodiment, the action body retention features 106 comprise a depression into which a blocking member, such as a screw, passing through the action body 100 may enter thereby blocking the removal of the action liner 104 from the action body 100 when the blocking member is inserted.

In a preferred embodiment, the action liner 104 further comprises feed ramp features 308. Action liner feed ramp features 308 are features configured to direct a cartridge passing into the chamber of the firearm.

The present invention further comprises a breech plug 102. In a preferred embodiment, the breech plug 102 is an article of manufacture which is a generally hollow cylinder. In a preferred embodiment, the breech plug 102 comprises feed ramp features 402 configured to direct a cartridge passing into the chamber of the firearm. In a preferred embodiment, the breech plug 102 comprises bolt passage 500 and bolt locking 502 features. In a preferred embodiment, bolt passage features 500 comprise raceways along at least a portion of the length of the breech plug through which bolt locking lugs may pass when the bolt is in an unlocked position. In a preferred embodiment, bolt locking features 502 comprise protrusions which prevent the rearward movement of a bolt relative to the breech plug by sitting behind bolt locking lugs when the bolt is in a locked position.

In a preferred embodiment, the breech plug 102 comprises a barrel offset feature 110. In a preferred embodiment, the barrel offset feature 110 comprises a portion of the wall of the breech plug 102 which is longer than another portion of the wall of the breech plug 102. The barrel offset feature 110 is configured to maintain the position of the breech plug 102 between the barrel and the back of the action liner 104. In a preferred embodiment, the length of the breech plug 102, including the barrel offset feature 110, is less than the distance from the breech end of the barrel to the front of the inside of the action liner. In a preferred embodiment, the barrel offset feature 110 does not block pressure relief features of the wall of the action liner 104.

In an alternative embodiment, the breech plug barrel offset feature comprises pressure relief blocking features. In a preferred embodiment, pressure relief blocking features comprise a portion of the barrel offset feature which is configured to extend around the perimeter of barrel plug such that it covers one or more pressure relief features in the action liner. For right-handed shooters, the pressure relief blocking features preferably block pressure relief feature(s) in a left side of the firearm. For left-handed shooters, the pressure relief blocking features preferably block pressure relief feature(s) in a right side of the firearm.

In a preferred embodiment, the breech plug 102 is preferably retained in the action liner 104 by the barrel and/or barrel extension which is threaded into the action liner 104 thereby capturing the breech plug 102. In a preferred embodiment, the action liner 104 is preferably retained by a blocking member, such as a pin, passing through the action body 100 into a depression 106 of the action liner 104.

In a preferred embodiment, different components of the apparatus may be made of different metals based on desirable attributes for each. In a preferred embodiment, the breech plug is comprised of a steel alloy. In a preferred embodiment, the action liner is comprised of a steel alloy. In a preferred embodiment, the action body is comprised of aluminum. Each component may be made of different materials without deviating from the present invention.

Unless otherwise clearly indicated, in both the specification and claims, plurality means one or more. Unless otherwise clearly indicated, in both the specification and claims, a right circular hollow cylinder (or cylindrical shell) is a three-dimensional region bounded by two right circular cylinders having the same axis and two parallel annular bases perpendicular to the cylinders' common axis, as in the diagram.

The invention claimed is:

1. A firearm action comprising:

A. an action body having an opening at a first, muzzle, end wherein:

I. said action body is configured to removably accept an action liner,

B. said action liner comprises a generally cylindrical shell wherein:

I. said action liner is configured to removably accept a breech plug; and

C. said breech plug comprises a generally cylindrical shell wherein:

I. said breech plug is open at both ends, and

II. said breech plug is configured with means for securing a firearm bolt.

2. The firearm action of claim 1 wherein:

A. said action liner is further configured with means for attaching a barrel to said action liner.

3. The firearm action of claim 2 wherein:

A. said means for attaching a barrel to said action liner comprise a plurality of threads on an interior wall of said action insert.

4. The firearm action of claim 3 wherein:

A. said barrel captures said breech plug between said barrel and a breech end of said action insert when said barrel is screwed into said plurality of threads on an interior wall of said action insert.

5. The firearm action of claim 3 wherein:

A. said action body is configured with means for retaining said action insert, and B. said action liner is configured means for being retained in said action body.

6. The firearm action of claim 5 wherein:

A. said means for retaining said action insert of said action body comprise:

I. a threaded hole through a wall of said action body substantially perpendicular to the axis of said action body, B. said means for being retained in said action body of said action liner comprise:

I. a hole in an exterior wall of said action insert, and

C. a threaded pin is configured to cooperatively interact with said threaded hole through a wall of said action body passing into said hole in an exterior wall of said action insert when assembled.

7. The firearm action of claim 2 wherein:

A. said action body is configured with a plurality of action liner alignment features, and B. said action liner is configured with a plurality of action body alignment features.

8. The firearm action of claim 7 wherein:

A. said plurality of action liner alignment features of said action body comprise:

I. a plurality of slots substantially parallel to a central axis of said action body, and B. said plurality of action body alignment features of said action liner comprise:

I. a plurality of projections configured to extend into said plurality of slots of said action body when said action liner is installed in said action body thereby preventing the rotation of said action liner relative to said action body.

9. The firearm action of claim 7 wherein:

A. said action liner is configured with a plurality of breech plug alignment features, and B. said breech plug is configured with a plurality of action liner alignment features.

10. The firearm action of claim 9 wherein:

A. said plurality of breech plug alignment features of said action liner comprise:

I. a plurality of projections extending radially inward from the interior of the wall of said action liner, and B. said plurality of action liner alignment features of said breech plug comprise:

I. a plurality of slots in the exterior wall of said breech plug configured to accept said plurality of projects thereby preventing rotation of said breech plug relative to said action liner when said breech plug is installed in said action liner.

11. The firearm action of claim 2 wherein:

A. said action further comprises a plurality of means for venting excess pressure.

12. The firearm action of claim 11 wherein said means for venting excess pressure comprise:

A. a plurality of holes passing through a side-wall of said action body,

B. a plurality of holes passing through a side-wall of said action liner, and

C. said plurality of holes passing through a side-wall of said action body align with said plurality of holes passing through a side-wall of said action liner.

13. The firearm action of claim 2 wherein:

A. said action liner further comprises a plurality of feed ramps configured to guide a cartridge entering said barrel attached to said firearm action into said barrel.

14. The firearm action of claim 2 wherein:

A. said breech plug further comprises a plurality of feed ramps configured to guide a cartridge entering said barrel attached to said firearm action into said barrel.

15. The firearm action of claim 2 wherein:

A. said action body is configured with a plurality of openings in a wall to accept a cartridge passing from outside the action to inside the action.

16. The firearm action of claim 2 wherein:

A. said action body is configured with means for attaching, directly or indirectly, a trigger.

* * * * *